US006249586B1

(12) United States Patent
Stoffel et al.

(10) Patent No.: US 6,249,586 B1
(45) Date of Patent: Jun. 19, 2001

(54) SLOT MICROPHONE

(75) Inventors: Axel Stoffel, Donaueschingen (DE); Zdeněk Škvor, Prague (CZ)

(73) Assignee: Fachhochschule Furtwangen, Furtwangen (DE)

( * ) Notice: Subject to any disclaimer, the term of this patent is extended or adjusted under 35 U.S.C. 154(b) by 0 days.

(21) Appl. No.: 09/010,032

(22) Filed: Jan. 21, 1998

(51) Int. Cl.[7] ..... H04R 25/00

(52) U.S. Cl. ..... 381/174; 381/191

(58) Field of Search ..... 381/174, 191, 381/113, 116; 367/170, 181; 29/25.41, 594

(56) References Cited

U.S. PATENT DOCUMENTS 4,885,781 * 12/1989 Seidel ..... 381/174

5,452,268 * 9/1995 Bernstein ..... 381/174

* cited by examiner

*Primary Examiner*—Huyen Le
(74) *Attorney, Agent, or Firm*—Paul Vincent

(57) ABSTRACT

The invention concerns a microphone, in particular, for manufacturing based on silicon micromechanical technology. The microphone comprises a first plate and a second plate positioned to form a gap with said first plate at a small separation therefrom. An acoustical membrane is integrated into the first plate. The air gap between the first and second plates is substantially smaller than a characteristic width dimension of the device so that a narrow slot-like entrance between the two plates is thereby defined. An acoustical signal entering into the air gap is guided in a wave guide fashion between the first and second plates to be detected by the acoustical membrane. In this manner a microphone having small lateral dimensions but nevertheless good acoustical sensitivity can be manufactured, in particular, using micromechanical techniques based on silicon technology.

14 Claims, 5 Drawing Sheets

SLOT MICROPHONE

BACKGROUND OF THE INVENTION

The invention concerns a miniature microphone assembly advantageously based on silicon technology which can preferentially be manufactured using micromechanical methods.

Microphones transform sound into electrical signals. Certain applications require a reduction in the size of a microphone, for example for use in hearing aids. However, a reduction in the size of the microphone often leads to a reduction in the size of the microphone signal due to an associated reduction in the size of the sound-detecting diaphragm. The miniaturization of microphones based on silicon technology has been effected with the assistance of micromechanical techniques. Towards this end it has been possible to reduce the size of microphone membranes to less than 1 $mm^2$. The sensitivity of such microphones is typically less than 1 mV/Pa. Current techniques allow for simultaneous manufacture of the microphones and integrated circuits on the same chip in order to be able to amplify the small signal directly at the location of signal production to thereby improve the signal-to-noise ratio. All microphones using this technology of prior art utilize a microphone membrane aligned perpendicular to the incident direction of the sound for maximizing the microphone sensitivity.

This technology has the disadvantage that, despite utilization of silicon chip technology, the chip area cannot be made as small as possible since signals of insufficient strength would thereby result for membrane sizes under 1 $mm^2$. In addition, the membrane is surrounded by a frame needed for membrane support and the electronic amplification circuit requires additional surface area to be accommodated within this frame so that the microphone surface which is actually available for sound purposes cannot be less than several $mm^2$ in size.

Departing from this prior art, it is a primary object of the present invention to improve this arrangement for miniaturized microphone assemblies based, in particular, on silicon technology to overcome the problems associated with large external frontal areas while nevertheless maintaining a good signal-to-noise ratio for the microphone and a compact overall size.

SUMMARY OF THE INVENTION

The purpose of the invention is primarily achieved in a microphone system comprising a first plate having a first width, a second plate positioned across and at a first separation from the first plate, an acoustical membrane integrated in the first plate, and a first spacer means disposed between the first and the second plates to hold the first plate at the first separation from the second plate and to define an air gap between the first and the second plates, wherein the first separation is substantially less than the first width.

In accordance with the invention, an acoustical wave guide is formed between the first and second plates for passing an incident acoustical signal wave into and along the air gap to be incident on and detected by the acoustical membrane. The geometry of the inventive microphone system allows for use of small rectangular or circular moving diaphragm or plate electrodes having areas typically between $0.2\times0.2$ $mm^2$ to $0.5\times0.5$ $mm^2$. This diaphragm is the acoustically active part of the transducer and is placed together with other parts of the system on a substrate plate for direct excitation by the incident acoustic pressure-wave. The diaphragm is situated at the front of the transducer and the size of the substrate plate determines the entire size of the assembly. The pressure sensitivity of the transducer thereby depends on the effective area of the diaphragm. The parallel geometry of the diaphragm along the air gap allows for the use of a plurality of diaphragm sensors to thereby increase the signal-to-noise ratio while maintaining the small overall size of the frontal portion of the microphone assembly.

In a particularly preferred embodiment of the microphone the first spacer means closes a first end of the air gap. This embodiment has the advantage of maintaining a stable separation between the first and second plates while providing a location for electronic circuit signal processing and for input and output leads for the electrical signals.

In an improvement of this embodiment, the first spacer means closes a first side of the air gap adjacent to the first end and a second side of the air gap adjacent to the first end and opposite the first side. This embodiment has the advantage that acoustical access to the air gap is from a front end of the device so that the air gap defines a closed wave guide system for the directed passage of the acoustical pressure wave into and through the air gap.

A preferred embodiment of the invention comprises a plurality of membranes integrated into the first plate. This embodiment has the advantage that an increased surface area for acoustical detection of the signal is facilitated without expanding the frontal dimensions of the device.

An improvement of this embodiment provides for a second plurality of membranes integrated into the second plate. This embodiment has the advantage that both the first and the second plates are acoustically active so that a larger fraction of the entire inner surface of the air gap defined by the first and second plates is utilized to produce acoustical signals for increasing the sensitivity of the device while largely maintaining its overall size.

A particularly preferred variation of this embodiment provides for a stacked system of microphone structures having a plurality of plates each pair of which having an air gap defined and separated by a spacer means. All of the plates adjacent to the respective gaps can thereby be configured with acoustically active membranes so that maximum usage of the inside area of the gaps for detection of the incident acoustical pressure wave is facilitated. This embodiment can be particularly envisioned as comprising a third plate having a third width, stacked above the first and the second plates, and having a third plurality of acoustical membranes as well as a fourth plate positioned above and at a second separation from the third plate, the fourth plate also having a fourth plurality of acoustical membranes. A second spacer means is then disposed between the third and the fourth plates to hold the fourth plate at the second separation above the third plate. As in the primary embodiment of the invention, the gap height is substantially smaller than the width of a typical dimension of the plates.

A preferred embodiment of the invention envisions silicon technology for processing the first and second plates. This embodiment allows for miniature silicon technology developments to be utilized, preferentially in a micromechanical fashion, to integrate mechanical and electronic requirements.

Another additional preferred embodiment envisions varying the separation between the first and second plates along a length of the plates. This embodiment allows for tailoring of the acoustical properties of the wave guide to, for example, compensate for attenuation effects along the length of the wave guide.

A preferred embodiment envisions an acoustical circular membrane having a diameter between 0.2 and 0.5 $mm^2$ or an acoustical rectangular membrane of dimensions between 0.2×0.2 and 0.5×0.5 $mm^2$. This embodiment has the advantage of comprising a membrane which can be advantageously manufactured using current micromechanical technology.

In an additional embodiment an acoustically transparent material is positioned between the first and the second plates to protect, isolate and define the air gap. This embodiment has the advantage of preventing dust and other foreign objects from gaining entrance to the sensitive internal components, in particular, to the membrane located within the air gap.

In an improvement of the above mentioned embodiment the acoustically transparent material has a desired acoustical impedance. This embodiment has the advantage of double use of the acoustically transparent material both as a protective material as well as a material with desired acoustical properties.

In a preferred embodiment of the invention the first separation is greater than 70 $\mu$m and less than 300 $\mu$m with the first width being greater than 1 mm and less than 2 mm. This embodiment has the advantage of having substantially small transverse dimensions while nevertheless allowing, in conjunction with membranes positioned in accordance with the invention, for good acoustical sensitivity.

Further advantages can be derived from the description and the accompanied drawing. The features of the drawing and the claims can be utilized in accordance with the invention either individually or collectively in arbitrary combination. The embodiments mentioned below are not to be considered as exhaustive enumeration of inventive configurations rather have exemplary character only for illustration of the invention.

DESCRIPTION OF THE PREFERRED EMBODIMENT

Figure 1:
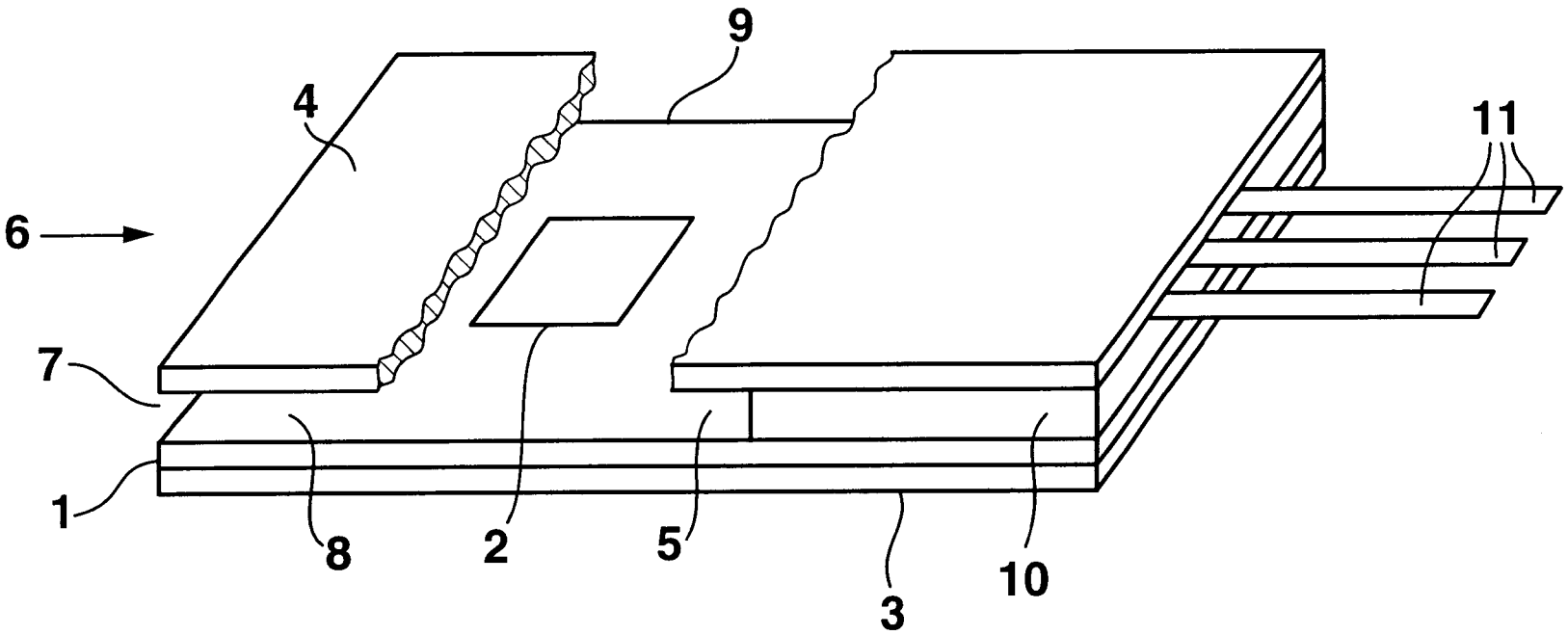
FIG. 1 shows a perspective view of one embodiment of the invention having an air gap opened at frontal and both lateral sides and closed at an end.

Identical reference numerals designate the same features in the various drawings.

In the embodiment of the invention shown in FIG. 1, a substrate plate 1 is configured with a rectangular, square, circular or similar diaphragm 2 which is sensitive to the detection of sound. The substrate plate 1 and diaphragm 2 are adjacent to a protecting plate 3. Lying across from the upper side of the diaphragm 2 is an additional adjacent plate 4. The substrate plate 1 and the adjacent protecting plate 4 define a gap 5 containing air and constituting an acoustical wave guide. The gap 5 can be open at the front and/or at the sides allowing lateral areas 8 and 9 of acoustical access to the gap 5 as well as frontal access 7. In the event that acoustical pressure waves are incident in the direction of arrow 6 into the gap 5, the acoustical wave is transmitted through the gap 5 and causes pressure fluctuations on the diaphragm 2 which are converted into electrical signals. The air gap 5 defined in this manner is closed at an end opposite to the incident direction of the acoustical waves given by arrow 6, by block 10. Block 10 can accommodate electronic circuit signal processing devices. Signal access into and out of the system in accordance with FIG. 1 can be effected through electrical output/input terminal pins 11.

Figure 2:
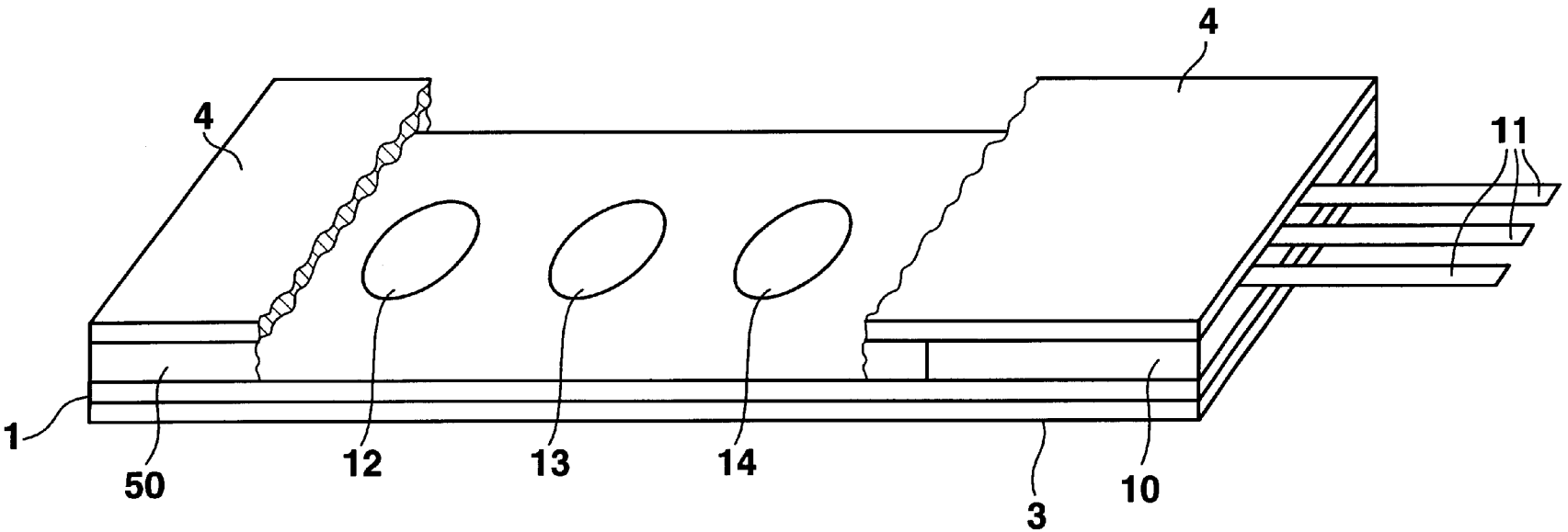
FIG. 2 shows an embodiment of the invention similar to that of FIG. 1 but with a plurality of acoustically sensitive membranes.

FIG. 2 shows an embodiment similar to that of FIG. 1 in which a plurality of diaphragms 12, 13 and 14 are positioned on the substrate 1. In addition, an acoustically transparent protecting layer 50 is provided along the edges of the gap to protect the inner portions of the gap from dust and foreign objects while allowing for passage of the acoustical pressure wave. The embodiment of FIG. 2 allows for a plurality of acoustically sensitive membranes in the longitudinal direction without increasing the transverse size of the device.

Figure 3:
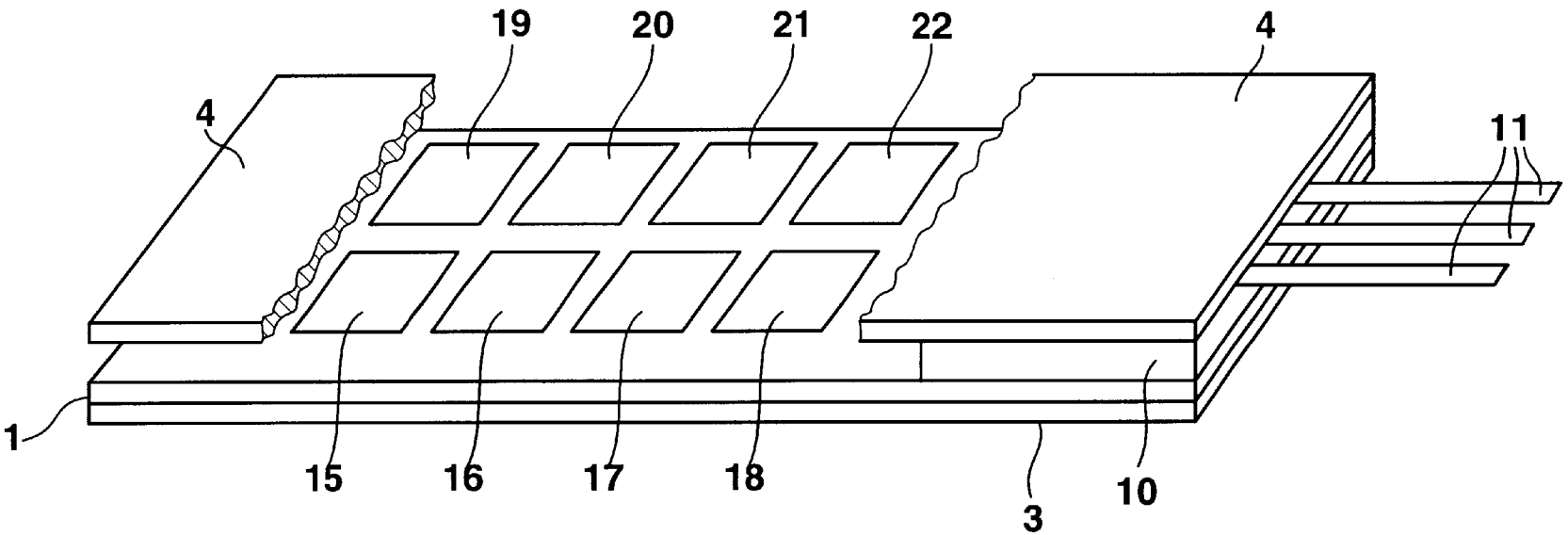
FIG. 3 shows an embodiment of the invention similar to that of FIG. 2 but having two parallel rows of acoustically sensitive membranes positioned within the gap.

The embodiment of FIG. 3 provides for additional microphones 15, 16, 17, 18, as well as 19, 20, 21, and 22 disposed parallel to each other in mutually adjacent rows. In this manner nearly the entire inner surface of the gap at substrate 1 is utilized as sensitive acoustical area for the detection of the signals.

Figure 4:
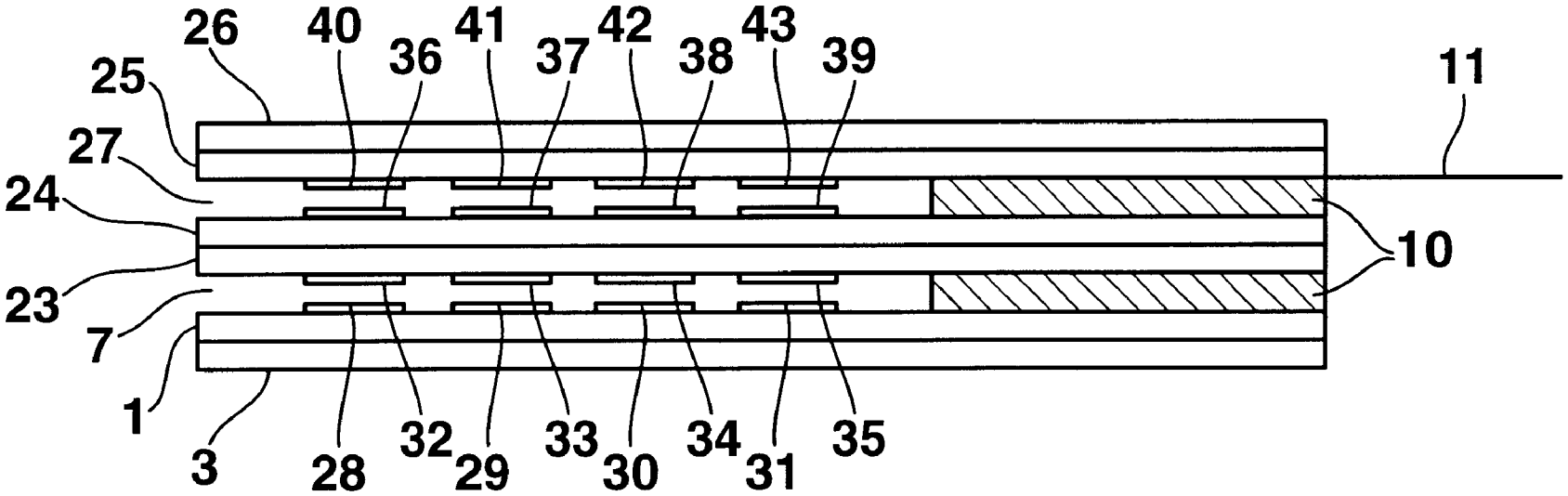
FIG. 4 shows a cross-section through a length of another embodiment of the invention having a plurality of stacked gaps and sensitive membranes on both sides of the gaps.

FIG. 4 extends this concept to a stacked configuration comprising active substrates 1, 23, 24 and 25. Substrate 1 has acoustical membranes 28, 29, 30 and 31 positioned thereon, substrate 23 is equipped with membranes 32, 33, 34, and 35, substrate 24 actively supports membranes 36, 37, 38 and 39 and substrate 25 actively cooperates with membranes 40, 41, 42 and 43. The protective plate 3 seats on the lower substrate 1 and an additional protective plate 26 on the upper substrate 25 to form a sandwich structure defining two gaps 27 and 7 between the substrates 25, 24 and 23, 1 respectively. In this fashion, the lateral height of the device is kept small but, through the stacked structure, substantially increased acoustical sensitivity is achieved.

Figure 5:
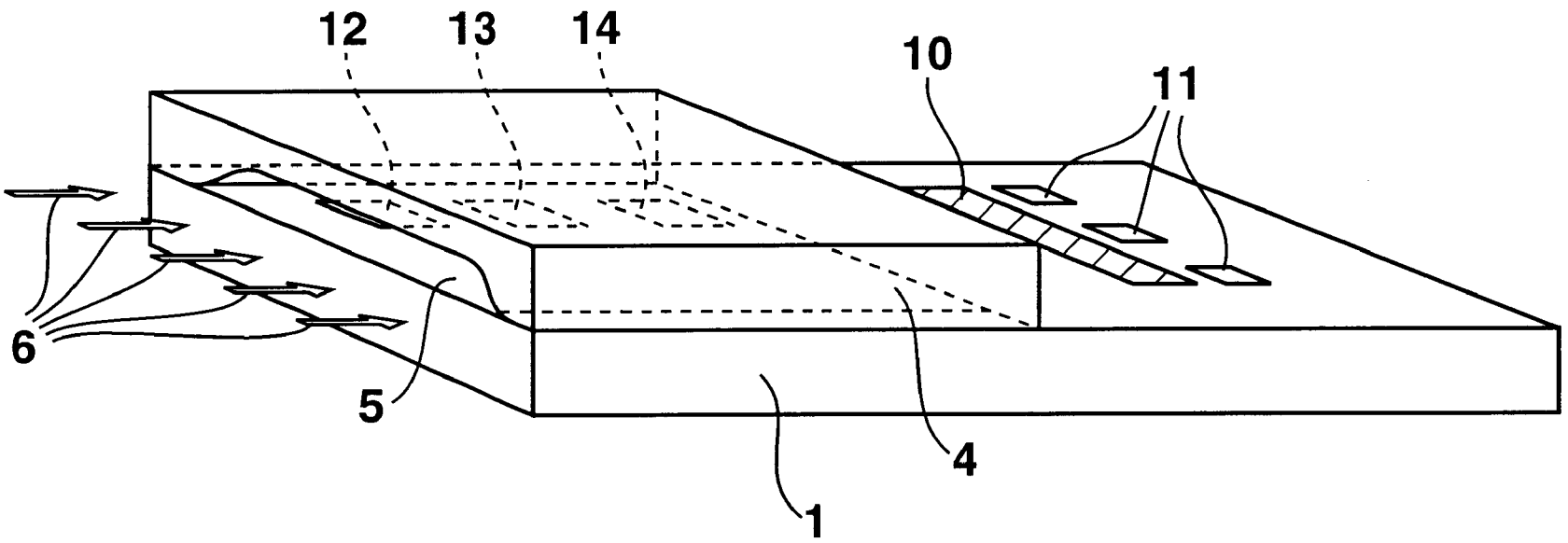
FIG. 5 shows a perspective view of an additional embodiment of the microphone in accordance with the invention having closed side walls.

FIG. 5 shows a perspective view of another embodiment of the invention having closed side walls. In this embodiment the upper plate 4 has closed walls defining a gap 5 into which the incident sound 6 is directed in the direction of arrow 6. A plurality of acoustical diaphragms 12, 13 and 14 are integrated into the substrate 1. Integrated circuits 10 are provided for behind the region of the cover plate 4 on the substrate 1 for processing electrical signals from the diaphragms 12, 13, and 14. Signal output and input into the device is facilitated by leads 11 in proximity to the integrated circuits 10.

We claim:

1. A microphone comprising:

a first plate having a first width and a first side;

a second plate having a second side positioned across from and at a first separation from said first side, said first separation being less than said first width, a first spacer means disposed between said first and said second sides to hold said first plate and said second plate at said first separation for defining an air gap between said first and said second sides; and an acoustical membrane integrated in said first plate at said first side, said acoustical membrane substantially parallel to said first side, wherein said first plate and said second plate are substantially solid and nonperforated in regions thereof proximate said acoustical membrane such that external sound waves can only gain access to said acoustical membrane after entering into and propagating through said gap in a direction substantially parallel to said acoustical membrane.

2. The microphone of claim 1, wherein said first spacer means closes a first end of said air gap.

3. The microphone of claim 1, wherein said first spacer means comprises an electronic device for acoustic signal processing.

4. The microphone of claim 2, wherein said first spacer means closes a first side of said air gap adjacent to said first end and a second side of said air gap adjacent to said first end and opposite said first side.

5. The microphone of claim 1, wherein said first and said second plates comprise silicon.

6. The microphone of claim 1, wherein said first separation varies along a length of said first plate.

7. The microphone of claim 1, wherein said acoustical membrane is circular and has a diameter between 0.2 and 0.5 mm.

8. The microphone of claim 1, wherein said acoustical membrane is rectangular with side lengths between 0.2 and 0.5 mm.

9. The microphone of claim 1, further comprising an acoustically transparent material between said first and said second plates to protect, isolate and define said air gap.

10. The microphone of claim 9, wherein said acoustically transparent material has a desired acoustical impedance.

11. The microphone of claim 1, wherein said first separation is greater than 50 $\mu$m and less than 300 $\mu$m and said first width is greater than 1 mm and less than 2 mm.

12. A microphone comprising:

a first plate having a first width;

a second plate positioned across from and at a first separation with respect to said first plate;

a first plurality of acoustical membranes integrated in said first plate, each of said membranes for non-resonant vibration in response to direct excitation by sound waves; and first spacer means disposed between said first and said second plates to hold said first plate at said first separation from said second plate for defining an air gap between said first and said second plates, said first separation being less than said first width, wherein an acoustical wave in said air gap can only be detected by said acoustical membranes after entering into and propagating through said air gap in a direction substantially parallel to said membranes.

13. The microphone of claim 1, further comprising a second plurality of membranes integrated in said second plate.

14. The microphone of claim 13, further comprising a third plate having a third width, stacked above said first and said second plates and having a third plurality of acoustical membranes and a fourth plate positioned above and at a second separation from said third plate, said fourth plate having a fourth plurality of acoustical membranes and with a second spacer means disposed between said third and said fourth plates to hold said fourth plate at said second separation above said third plate, wherein said second separation is less than said third width.

* * * * *